US005143293A

United States Patent [19]

Pairis

[11] Patent Number: 5,143,293

[45] Date of Patent: Sep. 1, 1992

[54] MIST-PRODUCING DEVICE

[76] Inventor: Raul R. Pairis, 40880-B Country Center Dr., #Q, Temecula, Calif. 92591

[21] Appl. No.: 587,120

[22] Filed: Sep. 24, 1990

[51] Int. Cl.[5] ..... B05R 1/34

[52] U.S. Cl. ..... 239/222.17; 239/383; 239/467; 239/493

[58] Field of Search ..... 239/222.17, 381, 382, 239/383, 467, 491, 493, 566

[56] References Cited

U.S. PATENT DOCUMENTS

| | | | |
|---|---|---|---|
| 666,297 | 1/1901 | Winkle | 239/383 |
| 932,718 | 8/1909 | Rachmann | 239/383 |
| 2,107,601 | 2/1938 | Davis | 239/493 X |
| 2,761,738 | 9/1956 | Swan | 239/383 |
| 2,796,293 | 6/1957 | Becker | 239/222.17 X |
| 3,601,316 | 8/1971 | Murray | 239/222.17 |
| 4,291,835 | 9/1981 | Kaufman | 239/381 |
| 4,721,250 | 1/1988 | Kennedy et al. | 239/493 X |

FOREIGN PATENT DOCUMENTS

| | | | |
|---|---|---|---|
| 320567 | 10/1929 | United Kingdom | 239/493 |

*Primary Examiner*—Andres Kashnikow
*Assistant Examiner*—William Grant
*Attorney, Agent, or Firm*—Boniard I. Brown

[57] ABSTRACT

A water mist-producing device includes a nozzle structure having a flow passage connected to a pressurized water source. A cylindrical pin is coaxially disposed in the passage so that pressurized water flows through an annular space between the pin and the passage wall surface. The downstream end of the pin abuts a transverse end wall having an exit hole assigned with the pin axis. Small angularly disposed flow ducts are defined in the downstream end portion of the pin to conduct jets of water across the end of the pin and through the exit hole. The angular disposition of the flow ducts effects spinning about its axis.

5 Claims, 2 Drawing Sheets

MIST-PRODUCING DEVICE

BACKGROUND AND SUMMARY OF THE INVENTION

The present invention relates to an apparatus for producing a water mist, i.e., atomized water particles of a fog-like nature. The apparatus is especially designed for low manufacturing cost and low operating cost.

Evaporative coolers and humidifiers have long been used to generate and distribute humidified air for such purposes as air conditioning and plant watering. In most cases, the apparatus involves the use of electric motors for pumping the air or atomizing the water, and operating costs are relatively high. The present invention contemplates a water-atomizing device which operates without electric motors or similar power devices. In one form of the invention, a nozzle structure has an elongated rotary pin rotatably arranged in a nozzle passage. Small angulated flow ducts are defined in the downstream end of the pin so that flow of pressurized water through the ducts imparts a rotary force to the pin. The pin rotates on its axis at a relatively high rotational rate, e.g., in excess of two thousand revolutions per minute.

These miniature flow ducts are arranged to discharge small jets of water into an expansion chamber defined between the downstream end of the rotating pin and an exit opening or hole in the nozzle structure. Flow through each duct is so restricted that the water is atomized into a multiplicity of very small particles as it passes from a highly pressurized liquid condition at the inlet end of the duct to essentially atmospheric pressure at the outlet end of the duct. The rapid rotation of the pin causes each stream of water particles to have a spiralling motion as it exits the exit opening in the nozzle.

The spiral motions of the water particles generate centrifugal forces which disperse the water particles radially relative to the nozzle axis. The water particles are thus diffused over a relatively wide volume.

A plurality of nozzles having rotary pin atomizers therein may be spaced along a water header pipe to provide a fog or mist curtain. With the pipe disposed in an overhead location relative to a room or human habitation space, such as an outdoor patio or swimming pool deck, it is possible to lower the local space temperature by as much as thirty degrees. The cost of operation of the system is relatively low, because the system relies solely on the water supply pressure to perform the water-atomizing function.

DESCRIPTION OF PREFERRED EMBODIMENTS OF THE INVENTION

Figure 1:
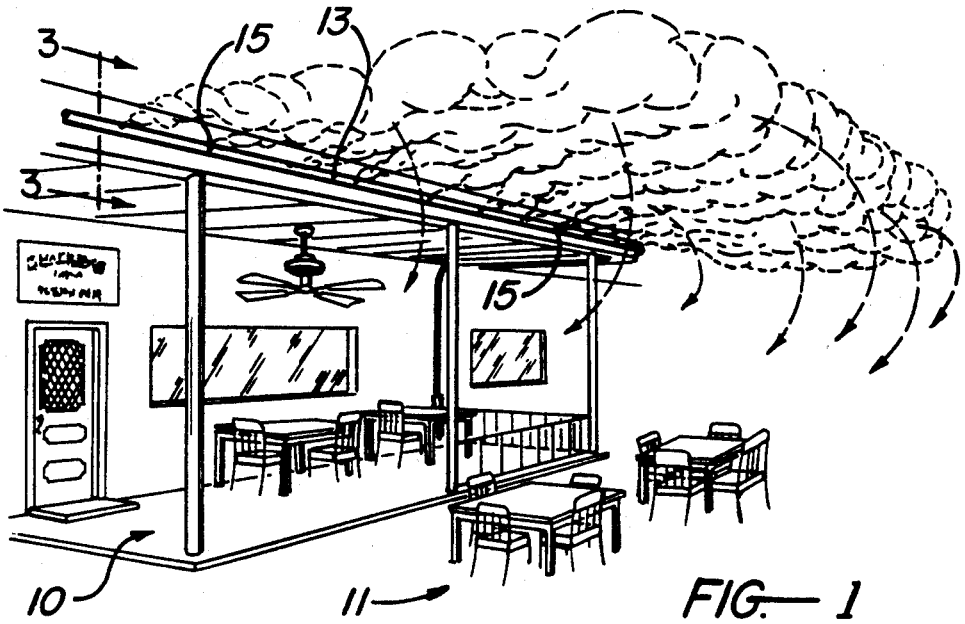
FIG. 1 is a perspective view of an outdoor restaurant utilizing a space cooling system according to the invention.
Figure 2:
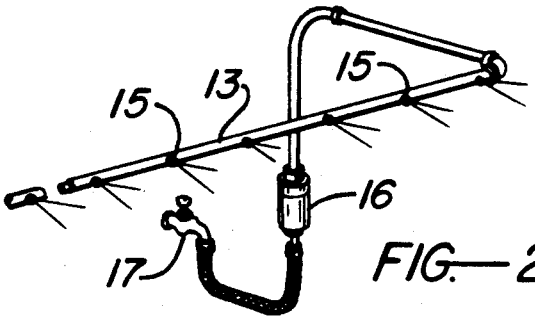
FIG. 2 is a perspective view of the space cooling system of FIG. 1 separated from the associated support mechanisms.
Figure 3:
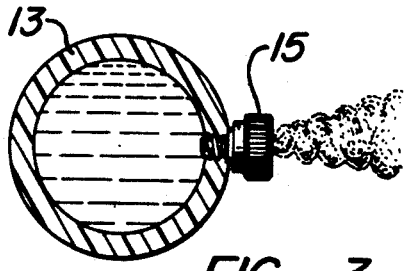
FIG. 3 is a transverse sectional view of a water header pipe of the FIG. 2 system.
Figure 4:
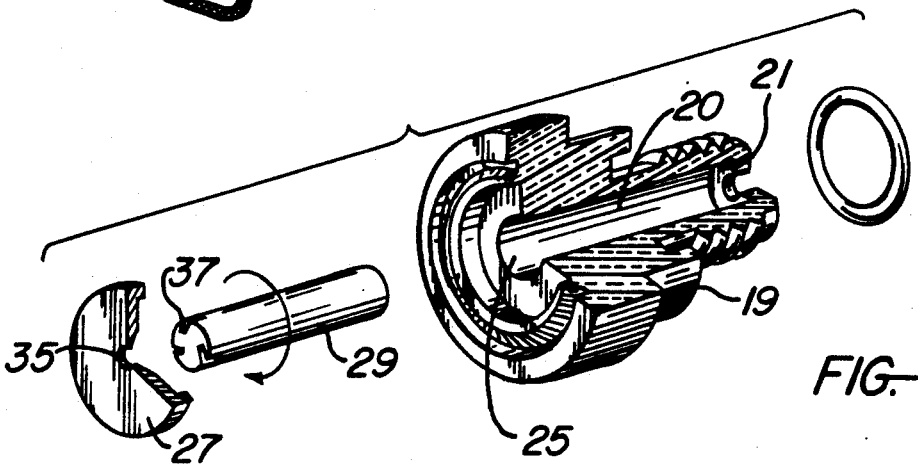
FIG. 4 is an exploded perspective view of a nozzle structure according to the invention.

Referring to FIGS. 1 and 2 of the drawings, there is shown a restaurant with an indoor space 10 and an outdoor space 11. A horizontal water header pipe 13 extends along a roof area of the restaurant at one edge of the outdoor space 11. Individual nozzle structures 15 are spaced along the length of header pipe 13 so that when a water control valve 17 (FIG. 2) is turned to its open position, the nozzles will generate a fine water mist in the area above space 11. The outdoor space will be thereby cooled by an evaporative cooling process. In preferred practice of the invention, a filter 16 is located between valve 17 and the header pipe.

The present invention relates to the construction of each nozzle structure 15. The nozzle structure of FIG. 6 comprises a nozzle housing 19 having a threaded screw-on connection to the wall of header pipe 13. The pipe may be formed of a light-weight plastic material, whereas the nozzle structure may preferably be formed of brass and/or stainless steel.

Nozzle housing 19 defines a cylindrical water flow passage 20 having an upstream end 21 communicating with water supply pipe 13, an annular cylindrical passage wall surface 23, and a downstream end 25. A transverse end wall 27 extends across the nozzle structure at the downstream end of passage 20.

A rotary flow restrictor pin 29 is floatably mounted in passage 20 with the peripheral surface 30 of the pin in near proximity to passage wall surface 23. Typically, pin 29 will have a diameter of approximately 0.1 inch and a length of about one-fourth inch. The radial clearance between pin side surface 30 and passage side surface 23 may be about 0.007 inch.

The water pressure in supply pipe 13 will be the prevailing utility water pressure in the locality in which the system is operating. Typically, the pressure would be in the range from about 40 p.s.i. to about 100 p.s.i. The radial clearance between pin 29 and passage surface 23 is preferably small enough that there is a slight pressure drop as water flows along the pin side surface into annular space 31 surrounding the downstream end of the pin. The pressure drop is relatively slight, e.g., only about five or ten p.s.i. Therefore, the water in annular space 31 is in a relatively pressurized condition. The purpose of this slight pressure drop is to ensure that the pin will be biased toward wall 27 with the downstream end of the pin engaged against the inner face of wall 27.

The downstream end of pin 29 is flat and normal to the pin axis. The registering surface of wall 27 has a conical depression therein which serves to define a water expansion chamber 33 between the end of pin 29 and the inner surface of wall 27. A circular opening 35 extends through wall 27 on the axis of passage 20. Opening 35 typically has a diameter of about 0.015 inch so that the pressure is substantially equalized across the opening. Chamber 33 is essentially at atmospheric pressure.

Figure 6:
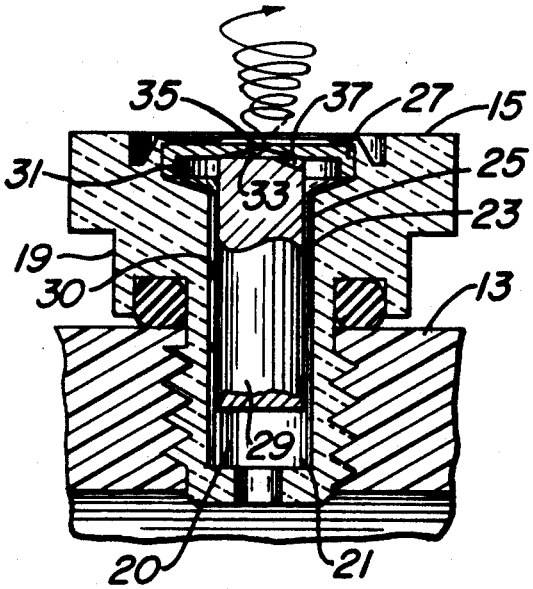
FIG. 6 is a sectional view taken through the FIG. 4 nozzle structure.
Figure 8:
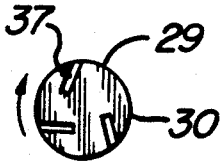
FIG. 8 is an end view of a flow restrictor pin utilized the nozzle of FIG. 6.

Water can flow from annular space 31 into expansion chamber 33 through three small flow ducts 37 formed in the downstream end of pin 29. FIG. 6 shows one of the three ducts in side elevation. The duct is a small slot or notch in the pin end surface. FIG. 8 is an end view of pin 29, showing the orientation or direction of each flow duct. Each duct extends from the pin peripheral surface at an acute angle to an imaginary radial line taken from the pin axis; i.e. on a chordal line as viewed in FIG. 8. The chordal angulations of the three flow ducts causes the water flowing through the ducts to exert a rotary force on pin 29, as indicated by the directional arrow in FIG. 8.

As previously noted, the water in annular space 31 is pressurized, whereas the air in central opening 35 is at atmospheric pressure. As water flows through each duct 37 toward hole 35, it seeks the most direct path from the pressurized space 31 to the hole space 35, and such path is a radial path from the intake end of each duct 37 to the hole 35 axis. The angulation of each duct 37 from a radial orientation causes the water in each duct to exert a rotational force on pin 29. In practice, the pin has a rotational velocity in excess of two thousand revolutions per minute because of the substantial pressure drop in flow ducts 37.

Each flow duct 37 has a relatively small flow area, e.g., only about 0.00003 square inch. Typically, each slot 37 has an axial depth dimension of about 0.003 inch and a width dimension of about 0.01 inch, whereby the slot has a pin hole dimension. As the pressurized water emerges from each miniature duct 37 into atmospheric chamber 33 it experiences rapid depressurization, which causes the water to separate into a large multiplicity of fine particles. At the same time, the water is subjected to centrifugal forces due to the spinning of pin 29 on its axis. The water particles are discharged through central opening 35 in successive helical sprays, as indicated generally by the helical path line in FIG. 6. The water particles are subjected to a centrifugal force field which helps to diffuse the particles into the atmosphere. In this connection, it will be noted from FIG. 6 that the axial spacing between the flat end of pin 29 and hole 35 is substantially less than the pin radius so that the helical motion of the water particles generated by the pin rotation is continued within chamber 33 rather than being dissipated.

The cumulative effect of a plurality of nozzles 15 spaced along a horizontal water header pipe 13 is depicted in FIG. 1. A water mist blanket is formed over the outdoor space 11. The fine water particles evaporate in the hot outdoor atmosphere to cool space 11 as much as thirty degrees. Operational cost of the system is only the cost of the water taken from the utility water supply.

FIG. 1 illustrates only one particular environment in which the invention may be utilized. The mist-producing system may also be used in or near swimming pool decks, patios, pet kennels, horse corrals, greenhouses, outdoor garden areas, and industrial gas-liquid contact apparatus. The nozzle structure may be employed as a single unit or in banks of nozzles, as shown in FIG. 1.

Figure 9:
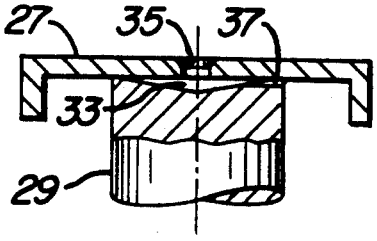

FIG. 9 shows a structural variation of the nozzle unit of FIG. 6, wherein expansion chamber 33 is formed by a conical depression or surface in the end surface of pin 29. Each flow duct 37 is formed in the conical surface.

Figure 10:
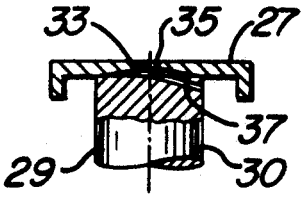
FIGS. 9 and 10 are fragmentary views showing details of alternate structural details which may be utilized in the nozzle of FIG. 6.

FIG. 10 shows an alternative form of flow ducts 37. Each duct comprises a tiny hole or passage drilled or otherwise formed in the end portion of pin 29. The number of flow ducts 37 may be varied, e.g., two ducts, four ducts, etc. may be utilized. The ducts should be inclined or angled in the same direction, as indicated in FIG. 8.

Figure 5:
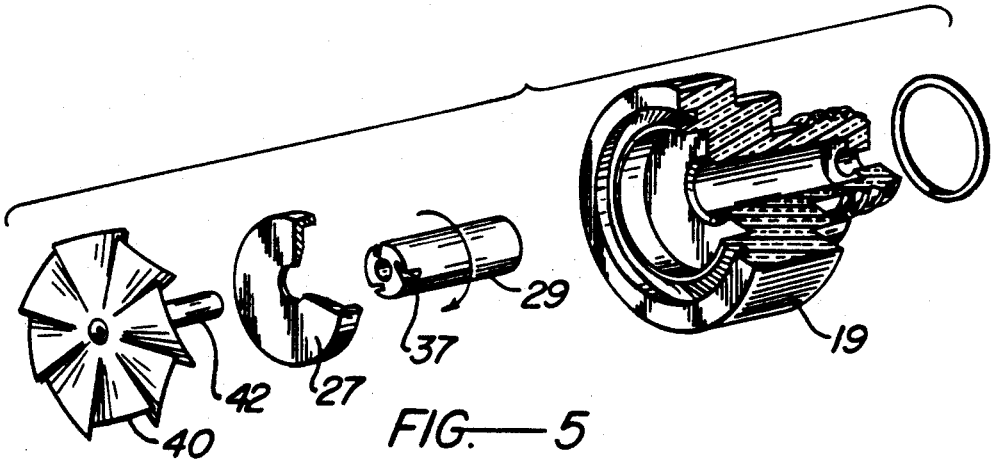
FIG. 5 is a view taken in the direction of the view of FIG. 4 showing an alternate nozzle structure.
Figure 7:
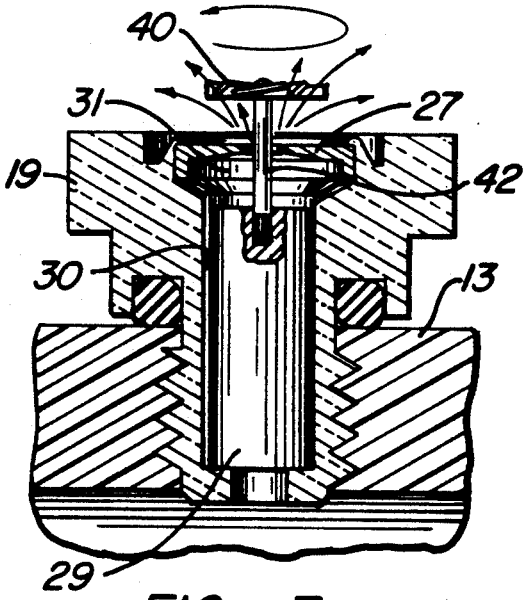
FIG. 7 is a sectional view taken through the FIG. 5 nozzle structure.

FIGS. 5 and 7 show another embodiment of the invention, wherein lateral diffusion of the mist after discharge through the opening in end wall 27 is enhanced by a rotatable vaned deflector 40 connected to pin 29 by a rod 42 and rotates with the pin. The rod extends through the central hole in wall 27, with an annular clearance between the rod and the hole edge, thus to allow passage of the water mist from the expansion chamber to the rotating vanes of deflector 40. With water pressure in header pipe 13, pin 29 will have its downstream end engaged against end wall 27 in the manner shown in FIG. 6. The vanes in deflector 40 will be oriented to accelerate lateral diffusion of the water mist particles, as indicated by the arrows in FIG. 7, some mist particles passing through the vane spaces.

Thus there has been shown and described a novel mist-producing device which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A water mist-producing device, comprising:

a nozzle housing having a flow passage therein defined at least partially by a cylindrical wall surface, said passage having an upstream end exposed to water supply pressure and a downstream end at a lower pressure, said cylindrical wall surface having a longitudinal axis defining the axis of the passage, a transverse end wall in said housing extending across said downstream end of the flow passage, said transverse end wall defining a hole, a rotary cylindrical flow restrictor pin floatably disposed in said passage and having an upstream end exposed to the water supply pressure, a cylindrical side surface within and in spaced relation to said cylindrical wall surface for flow of water axially between the pin side surface and the cylindrical wall surface, and a downstream end in registration with said transverse end wall, the radial clearance between the pin side surface and the wall surface being sufficiently small that a measurable pressure drop is produced between the pin upstream and downstream ends, whereby the water supply pressure urges the pin downstream end into engagement with said transverse end wall, said transverse end wall and the downstream end of the pin being so configured that a chamber is defined between said hole and the downstream end of the pin when the pin is engaged with the transverse end wall, said pin engaging the transverse end wall along a circumferential edge portion of the pin end, so that said chamber is concentric with the hole, said restrictor pin having a plurality of miniature flow ducts in its downstream end to conduct jets of water from the pin side surface to said chamber when the pin is engaged with the transverse end wall, each miniature flow duct extending from the pin side surface at a chordal angle, whereby water flowing within the ducts exerts rotary force on the pin, said hole having a cross-sectional area of sufficient size that fluid in said chamber is essentially at atmospheric pressure, said hole having a cross-sectional area substantially greater than the combined cross-sectional area of the miniature flow ducts so that water is rapidly depressurized upon entering said chamber, whereby the water is separated into a large multiplicity of fine particles before reaching the hole in the end wall.

2. The device of claim 1, wherein:

said chamber is defined by a conical recess in said transverse end wall, and the axial spacing between the pin downstream end and the hole is substantially less than the pin radius, whereby the water particles have a pronounced helical swirl motion as they emerge from said hole.

3. The device of claim 1, wherein:

said hole is circular and has a diameter of about 0.015 inch, and each miniature flow duct has a cross-sectional area of about 0.00003 square inch.

4. The device of claim 1, wherein:

the water supply pressure is no more than about 100 pounds per square inch.

5. The device of claim 1, and further comprising:

rotatable mist deflector means downstream of said hole, and a connector rod extending from the pin through the hole to said deflector means, whereby the deflector means is rotated with the pin by water flow through the miniature ducts.

* * * * *